US010113315B2

(12) United States Patent
Cullen

(10) Patent No.: US 10,113,315 B2
(45) Date of Patent: Oct. 30, 2018

(54) DEBRIS EXCLUSION DEVICE FOR RAIN GUTTERS

(71) Applicant: Universal Manufacturing & Design, LLC, Palm Harbor, FL (US)

(72) Inventor: James M. Cullen, Aroda, VA (US)

(73) Assignee: Universal Manufacturing & Design, LLC, Palm Harbor, FL (US)

( * ) Notice: Subject to any disclaimer, the term of this patent is extended or adjusted under 35 U.S.C. 154(b) by 0 days.

(21) Appl. No.: 15/465,102

(22) Filed: Mar. 21, 2017

(65) Prior Publication Data

US 2018/0274239 A1 Sep. 27, 2018

(51) Int. Cl.
*E04D 13/076* (2006.01)

(52) U.S. Cl.
CPC ..... *E04D 13/076* (2013.01)

(58) Field of Classification Search
CPC ..... E04D 13/076
USPC ..... 52/12; 210/155, 162
See application file for complete search history.

(56) References Cited

U.S. PATENT DOCUMENTS 4,937,986 A * 7/1990 Way, Sr. ..... E04D 13/076 210/474
4,959,932 A * 10/1990 Pfeifer ..... E04D 13/076 52/12
5,406,754 A * 4/1995 Cosby ..... E04D 13/076 52/12
5,956,904 A * 9/1999 Gentry ..... E04D 13/076 210/474
6,598,352 B2 * 7/2003 Higginbotham ..... E04D 13/076 210/474
6,681,527 B2 * 1/2004 Baker ..... E04D 13/0725 52/11
6,931,792 B2 * 8/2005 McDonald ..... E04D 13/064 52/11
6,951,077 B1 * 10/2005 Higginbotham ..... E04D 13/076 210/499
8,261,493 B2 * 9/2012 Hedrick ..... E04D 13/076 210/155
8,997,403 B1 * 4/2015 Steinberg ..... F16M 13/02 52/11
9,127,463 B1 * 9/2015 Feldhaus ..... E04D 13/0725
2010/0287846 A1 * 11/2010 Lenney ..... E04D 13/0762 52/12
2011/0067318 A1 * 3/2011 Lenney ..... E04D 13/076 52/12
2012/0110923 A1 * 5/2012 Robins ..... E04D 13/076 52/12
2014/0215929 A1 * 8/2014 Lenney ..... E04D 13/076 52/12

(Continued)

FOREIGN PATENT DOCUMENTS

CA 2907291 A1 * 4/2016 ..... E04D 13/076
WO 2007100320 A1 * 9/2007 ..... E04D 13/076

*Primary Examiner* — Robert Canfield
(74) *Attorney, Agent, or Firm* — Larson & Larson, P.A.; Justin P. Miller; Frank Liebenow

(57) ABSTRACT

The disclosed device is a filtration system for rain gutters comprised of a frame that accepts a filter. The frame is adapted for installation on any style of gutter. The frame accepts a multitude of filters, allowing the guard to be tailored to the local environment.
The disclosed device supports the use of different filters in different sections of the installed system, allowing for a system tailored to the particular home.

11 Claims, 12 Drawing Sheets

(56) References Cited

U.S. PATENT DOCUMENTS

2016/0201329 A1* 7/2016 Ianelli ..... E04D 13/076
52/12
2017/0370105 A1* 12/2017 Bryer ..... E04D 13/064

* cited by examiner

DEBRIS EXCLUSION DEVICE FOR RAIN GUTTERS

FIELD

This invention relates to the field of rain gutters and more particularly to a device that prevents leaves and debris from entering rain gutters.

BACKGROUND

Rain gutters, commonly referred to using only the term "gutters," are narrow channels used to catch rainwater that would otherwise run off the edge of a roof. The gutters route the rainwater through downspouts, and then away from the foundation of the structure. By routing the water away from the structure the stability of the foundation is maintained.

The location of gutters along the edges of the roof is ideal for collecting water, but also results in the collection of debris. Leaves, small branches, pollen, and other debris washes into, or blows into, the gutters. Unlike the rainwater, this debris accumulate within the gutter. Over time this accumulation of debris compromises the gutter's ability to channel water.

Solving the problem of gutter debris is complicated by the conditions endured by gutters. In northern climates gutters are subject to cold temperatures and heavy snow loads in the winter, and warm direct sun in the summer. These extremes result in great temperature differences between seasons.

In the winter, gutters are blocked by snow, or melted and refrozen water. Such blocks create ice dams that channel water into the roofing material, causing leaks.

In desert climates, the temperature variations may be as frequent as daily. The diurnal temperature variation, or difference in a given day between the high temperature and the low temperature, may be as great as 45 degrees Fahrenheit. The result is great daily expansion and contraction of the gutter materials.

Furthermore, the type of debris to be filtered depends upon the location of the home, as well as the homeowner's trees. For example, maple leaves are broad with multiple points and pine leaves are slim with a single point. Thus, each of these leaves requires a different filter.

What is needed is a device that can be adapted to fit the local needs of the home, providing year-round debris exclusion in a permanently mounted system.

SUMMARY

The disclosed invention is a debris exclusion device for rain gutters comprised of a frame that accepts a filter. The frame is adapted for installation on standard K-style gutters, half round style gutters, and can be customized to fit any gutter style. The frame accepts a multitude of screen inserts, allowing the guard to be tailored to the local environment.

The disclosed device supports the use of different filters in different sections of the installed system, allowing for a system tailored to the particular home.

The device is separated into two primary portions: the frame, which forms the structure that attaches to the home and gutter; and the filter, which is the single or multi-layer barrier to the introduction of debris into the gutters.

The frame is a long member formed from sheet metal, aluminum, or an extrusion. In alternative embodiments it is a molded shape.

The long dimension of the frame lies along the length of the gutter, with the shorter dimension connecting the facia of the home to the outside edge of the gutter.

The frame supports the filter by capturing the filter edges in upper and lower capture channels. With its edges supported, the filter arcs across the frame, contacting the stiffening rib of the frame. The support of the stiffening rib is desirable because the preferred embodiments of the filter are flexible.

The stiffening rib exerts an upward force against the filter, causing the filter to bend. The material of the filter desires to return to its flat shape, thus the filter pushes against its retention channels. This force acts to hold the filter in place without any fasteners required, while still allowing the filter to be easily installed or removed.

The stiffening rib further provides support to the filter to prevent collapse when load is applied. For example, a load created by snow or ice.

The frame includes a multiplicity of drain holes. In the preferred embodiment the drain holes are staggered for strength. The drain holes may also be placed in a straight row arrangement. But a straight row arrangement is not the preferred embodiment because such an arrangement results in a reduction of stiffness by lining up the areas of thinner metal between the drain holes.

Installation of the frame at a declining angle relative to the side of the house helps to route the water into the below-mounted gutter. The frame includes an upper attachment section that, once affixed to the facia of a home, sets the declination angle at the preferred angle of seven degrees.

The water that passes over the edge of the roof first contacts the filter. Passing through the filter, the water enters the primary collection channel, or the section of the frame above the stiffening rib and bordering the house. This section is where the bulk of the water passes through the frame and into the gutter. The upper face of the stiffening rib preferably includes drain holes to catch any water that may flow down past the drain holes in the primary collection channel.

Depending on the speed and volume at which water is flowing off the edge of the roof, water may fall into the secondary collection channel, or lower collection channel. This lower channel also includes drain holes.

A common occurrence with mesh gutters is a capillary action that pulls water across all parts of the mesh surface area. While most of the water will fall through the mesh closer to the heavier flow of water coming off the roof, some water will travel to the far edge of the mesh, drawn by capillary action. To allow for drainage of any water that is drawn to the edge of the filter in the lower filter capture channel, weep holes are placed within the channel. The weep holes route the water back into the collection channel so that water is not seeping out of joints for several hours after precipitation has stopped.

The material of the frame preferably matches that of the gutter to which the frame is attached. By matching materials the coefficients of thermal expansion are equal. Thus, the gutter and frame expand and contract in concert. Expansion of the gutter and frame together avoids the generation of gaps caused by greater expansion of the gutter, or upward bowing of the device as gutters contract more than the device.

In the preferred embodiment the frame is manufactured from aluminum to match the most common gutter material. In alternative embodiments the frame is manufactured from vinyl, copper, steel, or other such materials.

Next the filter is discussed. The filter excludes debris from the gutter. The filter is installed without tools, and requires no mechanical fasteners to be securely held within the frame.

As mentioned above, the filter is held in place by compression applied by the frame.

The filter may be one of many constructions and materials. Such anticipated constructions include: wire mesh, commonly formed with square openings; metal sheeting with punched holes, commonly circular holes but other hole shapes are acceptable; plastic sheeting; fiberglass mesh; or any other permeable membrane.

While many potential filters exist, there are three preferred embodiments of filter: 42 micron stainless steel mesh with small penetrations, also referred to as a fine mesh; grating, with larger penetrations than the fine mesh; and a high flow filter, which has the largest penetrations in order to allow the greatest flow.

The 42 micron stainless steel mesh is too flexible to lock into the frame without additional support. Thus, the mesh is wrapped around an insert formed from a stiffer material. For example, an expanded metal insert. The mesh is then wrapped around four sides of the insert, locking the two filters together. An additional advantage of locking the mesh on all four sides is that the chance of delamination or detachment is eliminated. Delamination or detachment can occur when the mesh is affixed to the insert on fewer than four sides, with the insert and mesh separating from each other. The result is an internal gap or void. Such a space decreases the effectiveness of the filter, and may accumulate debris.

The 42 micron stainless steel mesh is a very fine filter—a filter with very small holes. Thus it is appropriate for areas with needle-like leaves, such as those from pine trees. Such leaves can pass through coarser filters.

By preventing nearly all debris from entering the gutters the rainwater is kept clean. This filtered rainwater is well-suited for reclamation for use in the home or garden.

The fine mesh is also well-suited to areas where embers may blow into gutters, potentially spreading a fire to debris within the gutter or to the home. Such embers are prevented from entering the gutter by the fine mesh.

The fine mesh is comprised of 50% open area. The percentage of open area is a measurement of how much of the surface area is unobstructed by the filter material. With an open area of 50%, half the surface area is occupied by the filter material, and half is unoccupied to allow water to flow through.

Open area is one factor that affects flow rate. A second factor is the size of each penetration in the filter material. Larger openings allow for greater flow, even if the percentage of open area is the same.

The second preferred option for the filter is referred to as grating. The grating has larger penetrations than the fine mesh. The grating is appropriate in areas where there are significant amounts of pollen because pollen may plug the holes in the fine mesh. But the penetrations are still small enough to prevent most debris from entering the gutters. The grating is 46% open area.

The third preferred filter is referred to as the high flow filter. The high flow filter has the largest penetrations of any of the preferred filters, thus allowing the greatest flowrate of water. Despite the larger openings, the high flow filter excludes larger leaves from the gutters, including birch, elm, maple, and so forth.

Given the ability of the frame to accept filters of different types in different parts of the system, the high flow filter may be installed in particular portions of a gutter system where high flow is anticipated. For example, where roof valleys discharge into the gutters.

The high flow filter is 58% open area. But more importantly to its operation, the holes are larger and thus do not impede the flow of water.

The filter types discussed above may be constructed using a metal mesh with diamond-shaped penetrations, known in the industry as expanded metal. Expanded metal is formed from a metal sheet that is slit or cut, and then stretched, forming diamond-shaped openings.

Expanded metal comes in a raised pattern or a flattened pattern. The raised pattern is preferred for this invention because the edges of the deformed metal form small dams, guiding flowing water into the channels of the gutter beneath the filter.

In various environments, different filters may be useful. It is contemplated by this disclosure that many more combinations of filter sizes can be used within the system.

A discussion of the process of installation is helpful to understanding additional benefits of the disclosed device.

Multiple frames are required to cover the gutters of any home. During installation the ends of adjacent frames are butted against one-another, forming a joint. Joints are often the weak part of any system. The disclosed frames overcome the issue of weakness at joints in two ways. First, integral tabs extend from the ends of each frame, which underlap the adjacent frames. Second, the joints between the filters are staggered, allowing each frame joint to be crossed by a solid filter. The filters then also overlap. The result is a solid debris exclusion system, without any gaps created between pieces.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
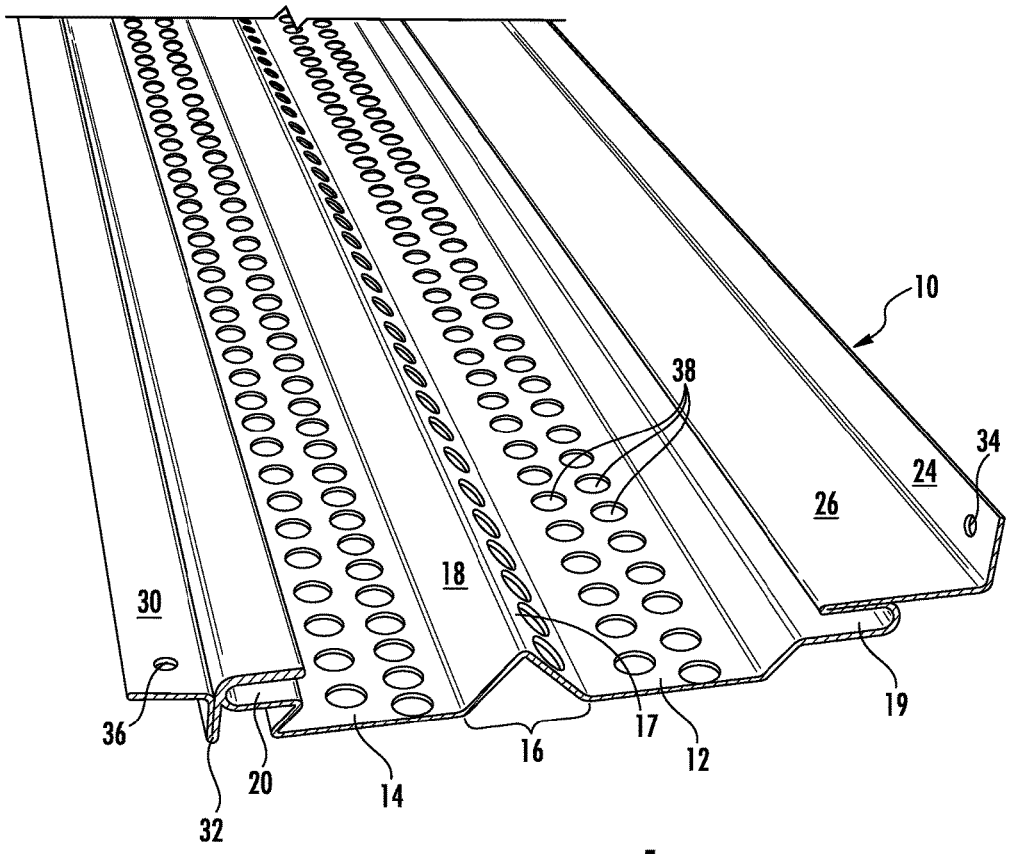
FIG. 1 illustrates an isometric view of a first embodiment.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of a first embodiment is shown.

The frame 10 acts as the structure component of the gutter debris exclusion device 1. The channel to the right is the primary collection channel 12 into which the majority of rainwater will flow during use. To its left in the figure is the secondary collection channel 14, which handles any additional rainwater. The primary collection channel 12 and secondary collection channel 14, in combination or individually, act as troughs. A trough is defined as a channel used to convey a liquid.

Between the two channels 12/14 is the stiffening rib 16. The stiffening rib 16 longitudinally divides the frame 10, encouraging water to pass through the frame before or at the centerline of the frame 10. The rainwater then falls to the center of the gutter.

The frame includes a multitude of drain holes 38. The drain holes 38 allow water to flow through the frame 10 and into the gutter. In the preferred embodiment the upper face 17 of the stiffening rib 16 includes drain holes 38. This allows flowing water to exit the frame 10, rather than passing over the stiffening rib 16. The lower face 18 does not require drain holes 38, and ideally any penetrations are excluded from the lower face 18 to increase its stiffness.

The frame 10 is affixed to the facia of the home. The facia is the portion of the roof between the edge of the roof and the outside of the home. It is generally a thin layer of material, commonly aluminum.

The upper attachment segment 24 of the frame 10 rests against the facia. Fasteners are installed through the upper mounting holes 34.

The upper transition segment 26 has an angle of greater than 90 degrees with respect to the upper attachment segment 24. This angle is further discussed in later figures.

The lower attachment segment 30 rests against the front lip of the gutter. The lower edge stop 32 rests just inside the gutter, preventing the frame 10 from sliding off the gutter during installation.

Fasteners are installed through the lower mounting hole 36.

Figure 2:
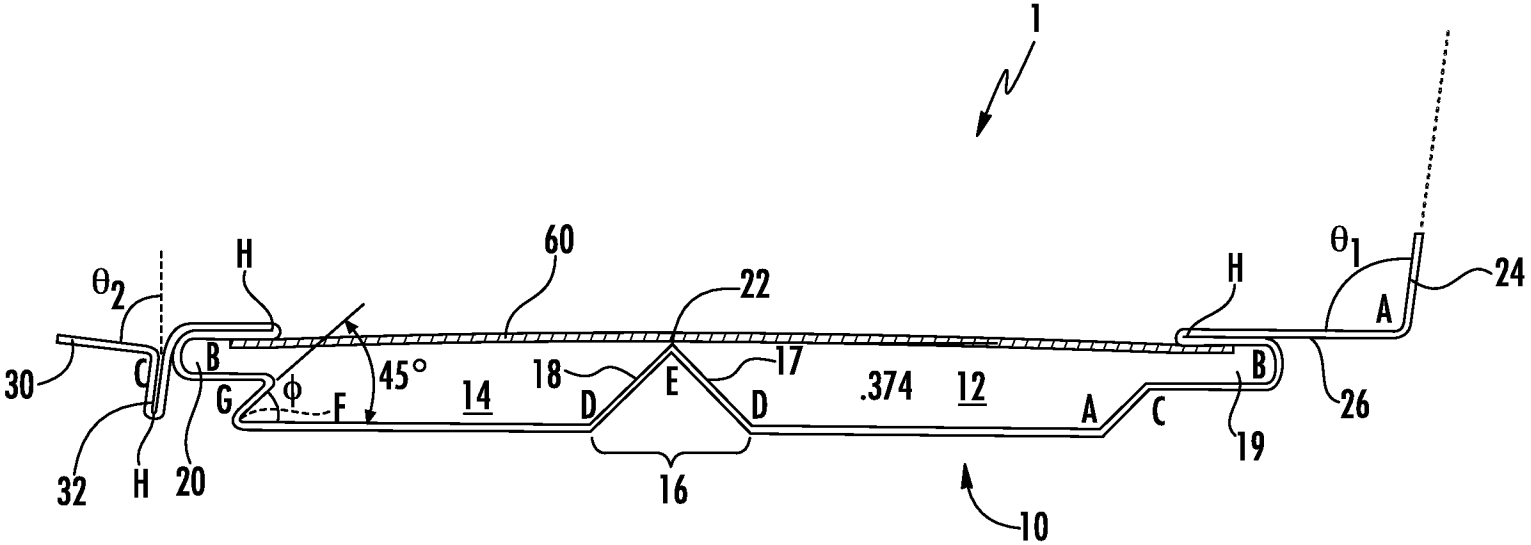
FIG. 2 illustrates a side view of the first embodiment.

Referring to FIG. 2, a side view of the first embodiment is shown.

The frame 10 is shown with primary collection channel 12 and secondary collection channel 14. The stiffening rib 16 is shown dividing the channels 12/14.

The upper filter capture channel 19 is shown holding the upper side of filter 60. The lower filter capture channel 20 is shown holding the lower side of filter 60. The filter 60 makes contact with the stiffening rib 16 at the filter support point 22.

The upper attachment segment 24 and upper transition segment 26 form a declination angle $\Theta_1$. In the preferred embodiment the declination angle $\Theta_1$ is ninety-seven degrees, or slightly greater than a right angle. Thus, when the upper attachment segment 24 is affixed to the facia of a home, the gutter debris exclusion device 1 has a slight downward slope.

On the opposite side of the frame 10, the lower attachment segment 30 forms an inclination angle $\Theta_2$ with respect to vertical. The declination angle $\Theta_1$ and inclination angle $\Theta_2$ are supplementary angles, or angles that add up to 180 degrees.

Between the secondary collection channel 14 and lower filter capture channel 20 a lower transition angle $\Phi$ is formed. In preferred embodiments this angle is forty-five degrees.

Figure 3:
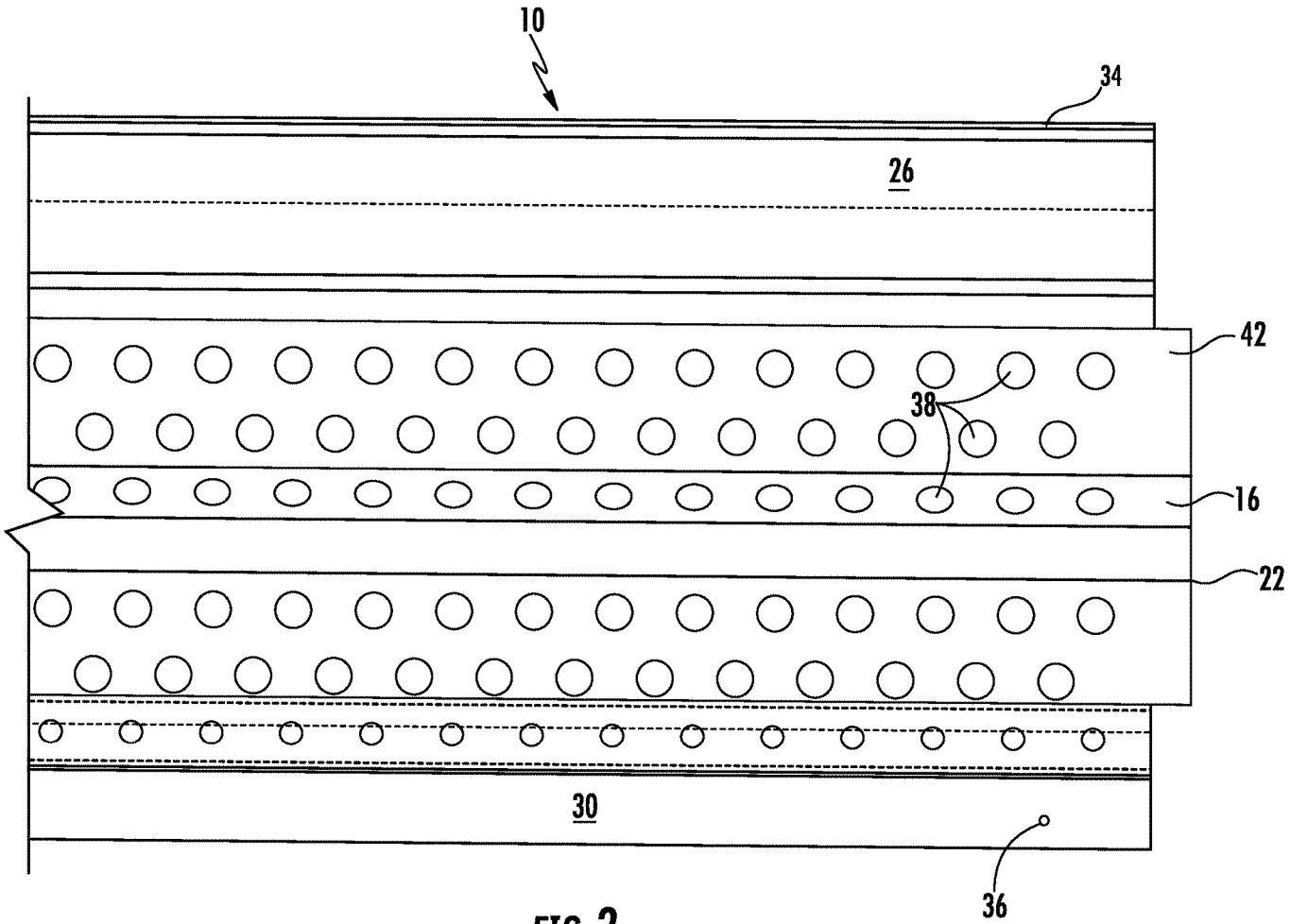
FIG. 3 illustrates a top view of the first embodiment.

Referring to FIG. 3, a top view of the first embodiment is shown.

The filter 60 is hidden in FIG. 3 in order to show only the frame 10. The drain holes 38 are readily visible. The overlap tab 42 is shown on the right end of the frame 10. When multiple frames 10 are joined the overlap tab 42 provides continuous structural stability.

Figure 4:
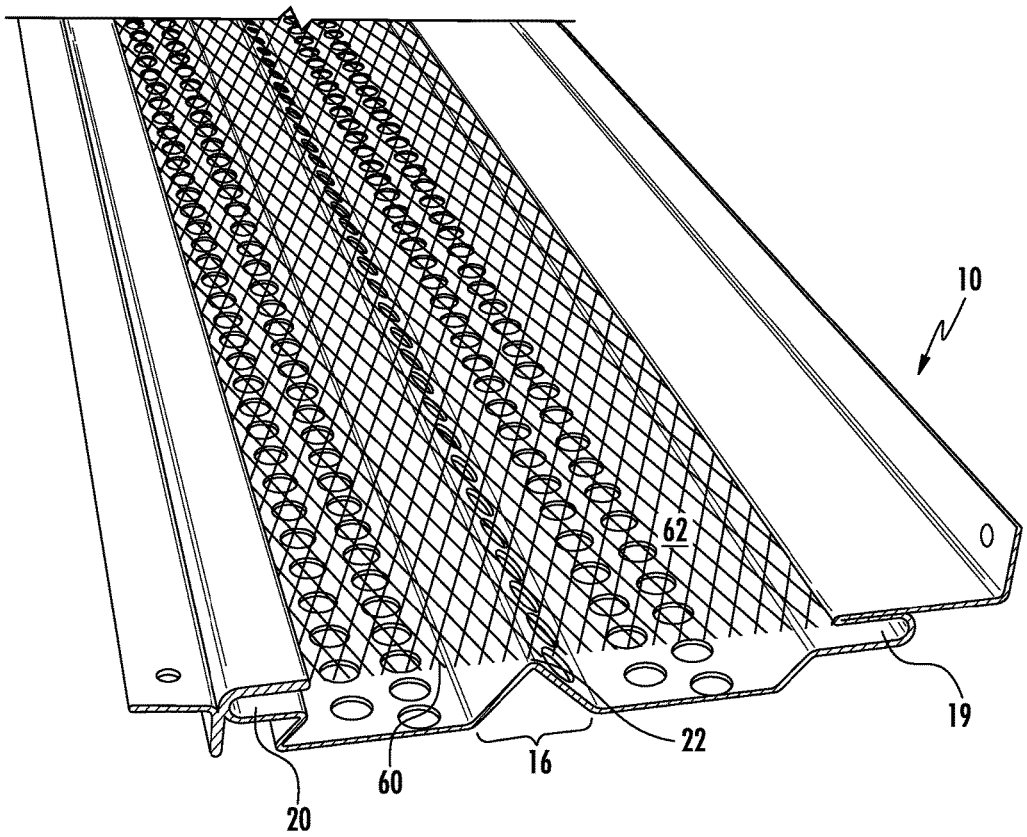
FIG. 4 illustrates an isometric view of the first embodiment with a screen installed.

Referring to FIG. 4, an isometric view of the first embodiment with a screen installed is shown. The filter support point 22 is shown contacting the filter 60, providing an upward force that maintains the filter 60 in position within the upper filter capture channel 19 and lower filter capture channel 20.

Figure 5:
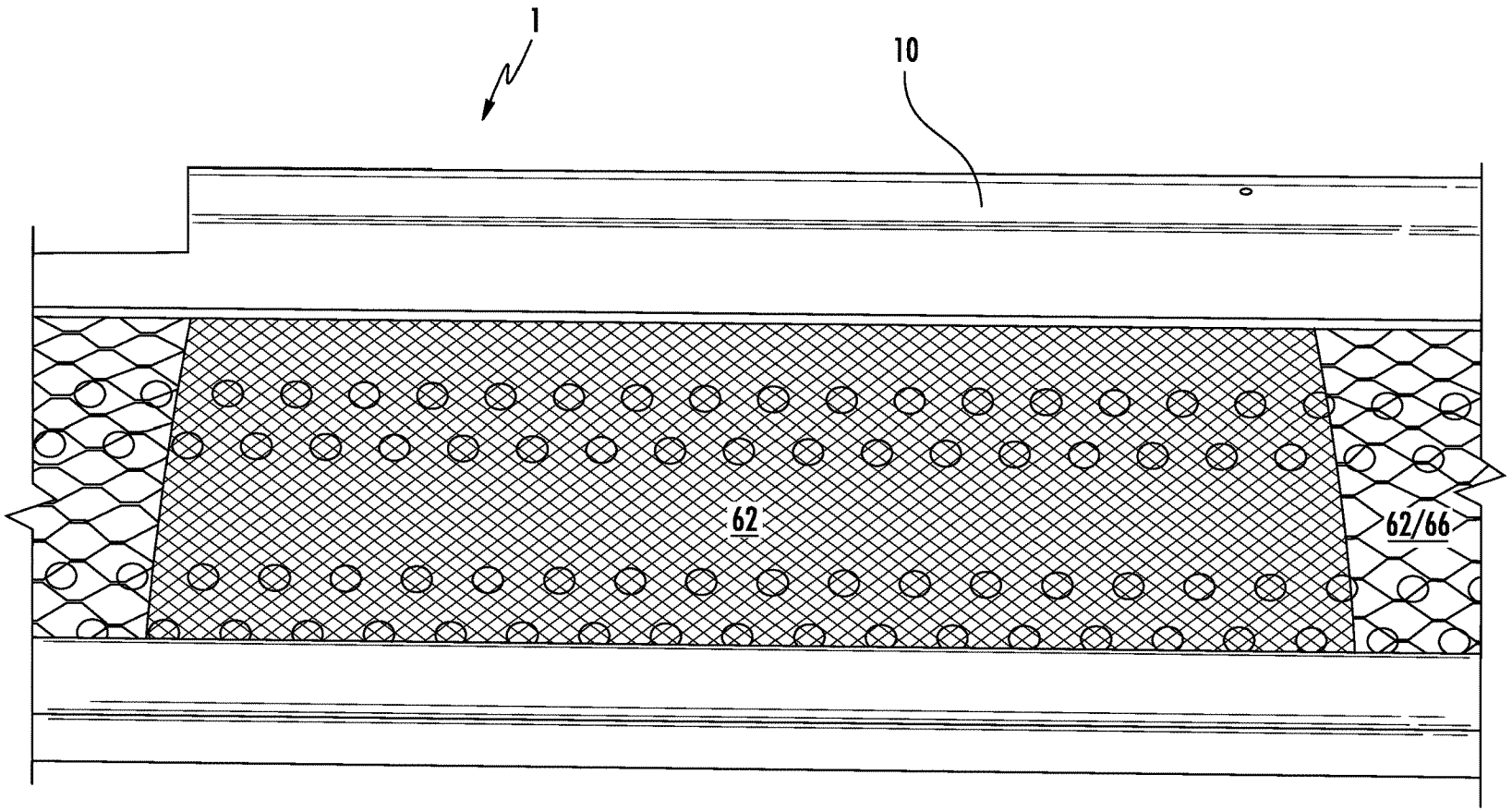
FIG. 5 illustrates a view of an embodiment with multiple filter types installed.

Referring to FIG. 5, a view of an embodiment with multiple filter types installed is shown. The gutter debris exclusion device 1 is shown with multiple types of filter 60 within the frame 10. The center filter 60 is an expanded metal 62 material, the filters 60 on either end are formed by wire mesh 66 wrapped around expanded metal 62.

The versatility allows the installer to tailor the filter 60 to the requirements of the gutter in a given location.

Figure 6:
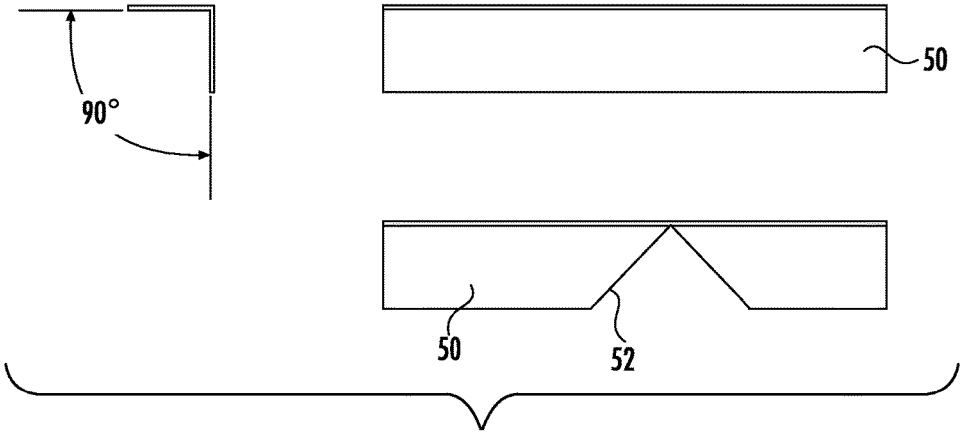
FIG. 6 illustrates a view of an end cap.

Referring to FIG. 6, a view of an end cap is shown. The end cap 50 includes a notch 52 to fit over the stiffening rib 16 during installation.

Figure 7:
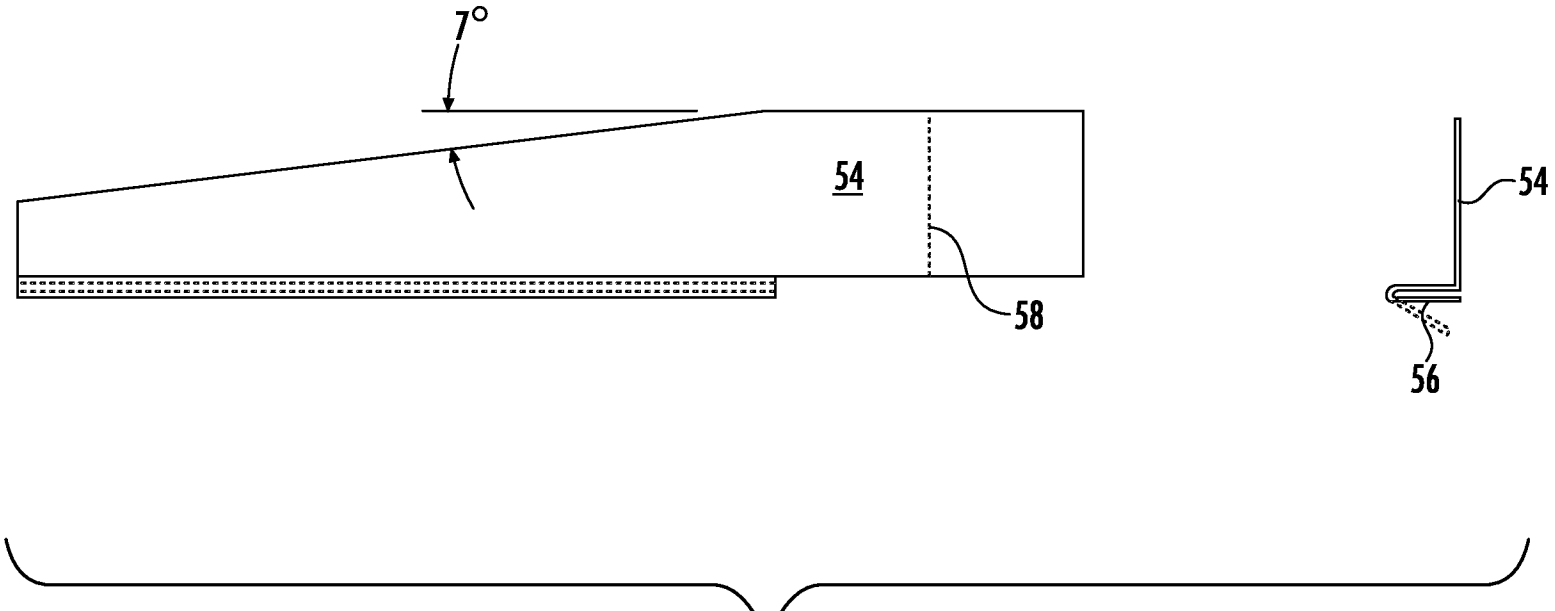
FIG. 7 illustrates a view of a dam.

Referring to FIG. 7, a view of a dam is shown. The dam 54 is affixed to the gutter by a crimped connection 56, which is closed using pliers during installation. During installation the dam 54 is optionally bent along fold line 58 to allow a section of the dam 54 to pass behind the gutter.

Figure 8:
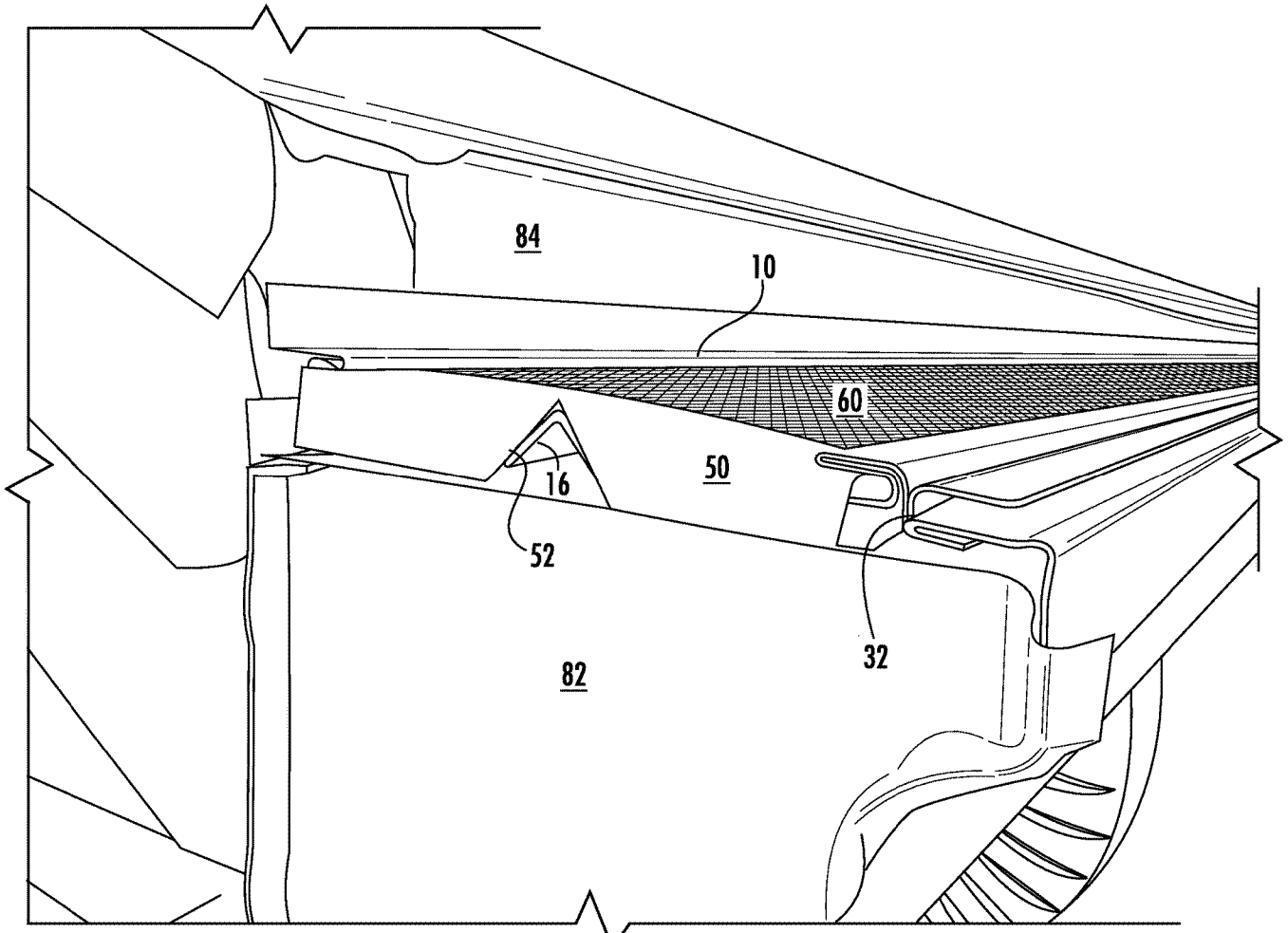
FIG. 8 illustrates the first embodiment installed on a home, with an end cap in place.

Referring to FIG. 8, the first embodiment is shown installed on a home with an end cap 50 in place. The gutter debris exclusion device 1 is shown installed on a gutter 82.

The end cap 50 holds the filter 60 in place within the frame 10, as well as helping to prevent debris from entering the end of the gutter debris exclusion device 1. The notch 52 is shown mating with the stiffening rib 16.

Frame 10 is affixed to the facia 84. The lower edge stop 32 rests against the inside of gutter 82, preventing the frame 10 from sliding forward during installation.

Figure 9:
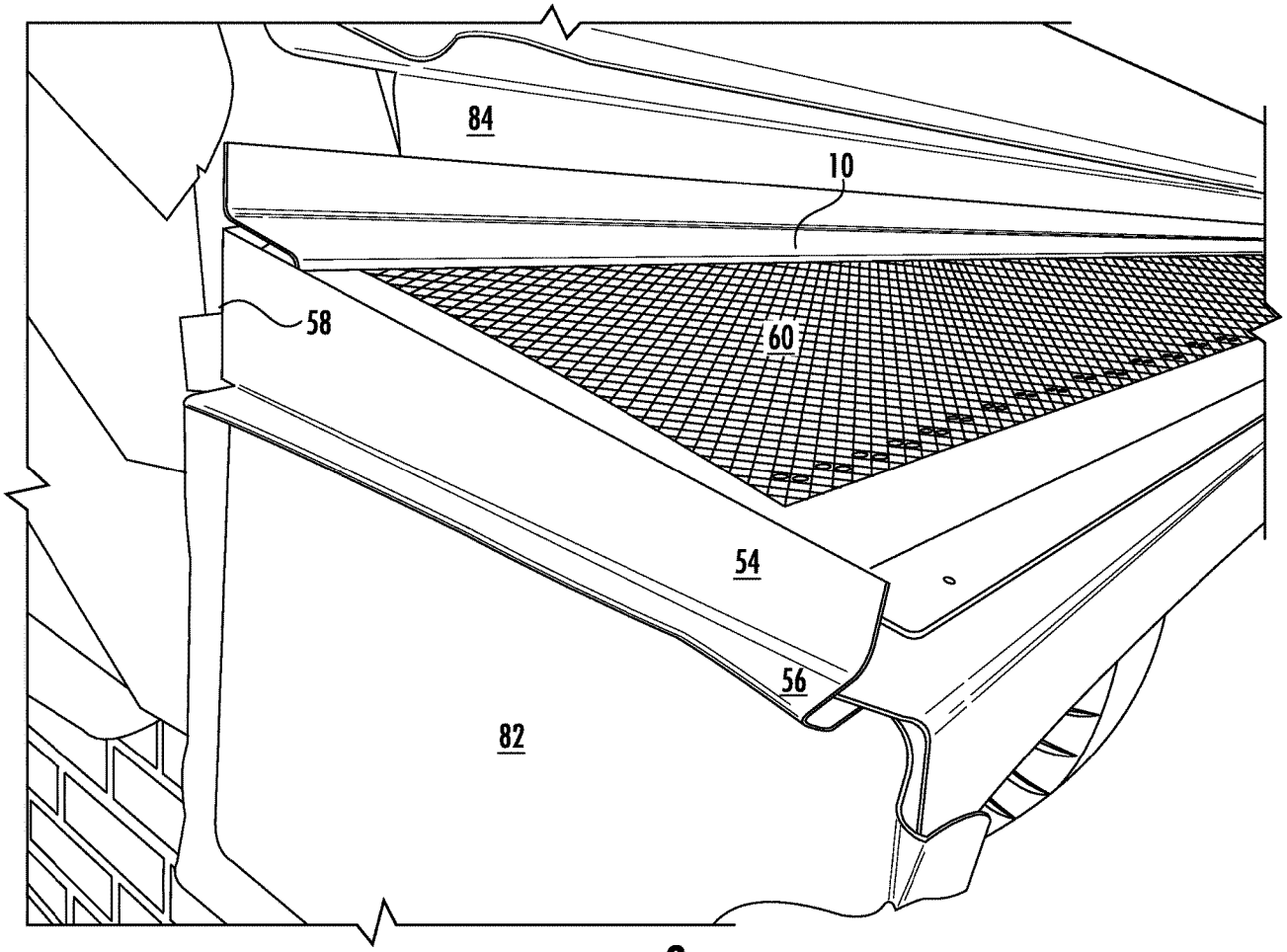
FIG. 9 illustrates the first embodiment installed on a home, with an end cap and dam in place.

Referring to FIG. 9, the first embodiment is shown installed on a home with an end cap and dam in place. The dam 54 is installed at the end of the frame 10, affixed to the gutter 82 by the crimped connection 56. The dam 54 is bent at the fold line 58, the remaining portion of the dam 54 placed behind the frame 10.

Figure 10:
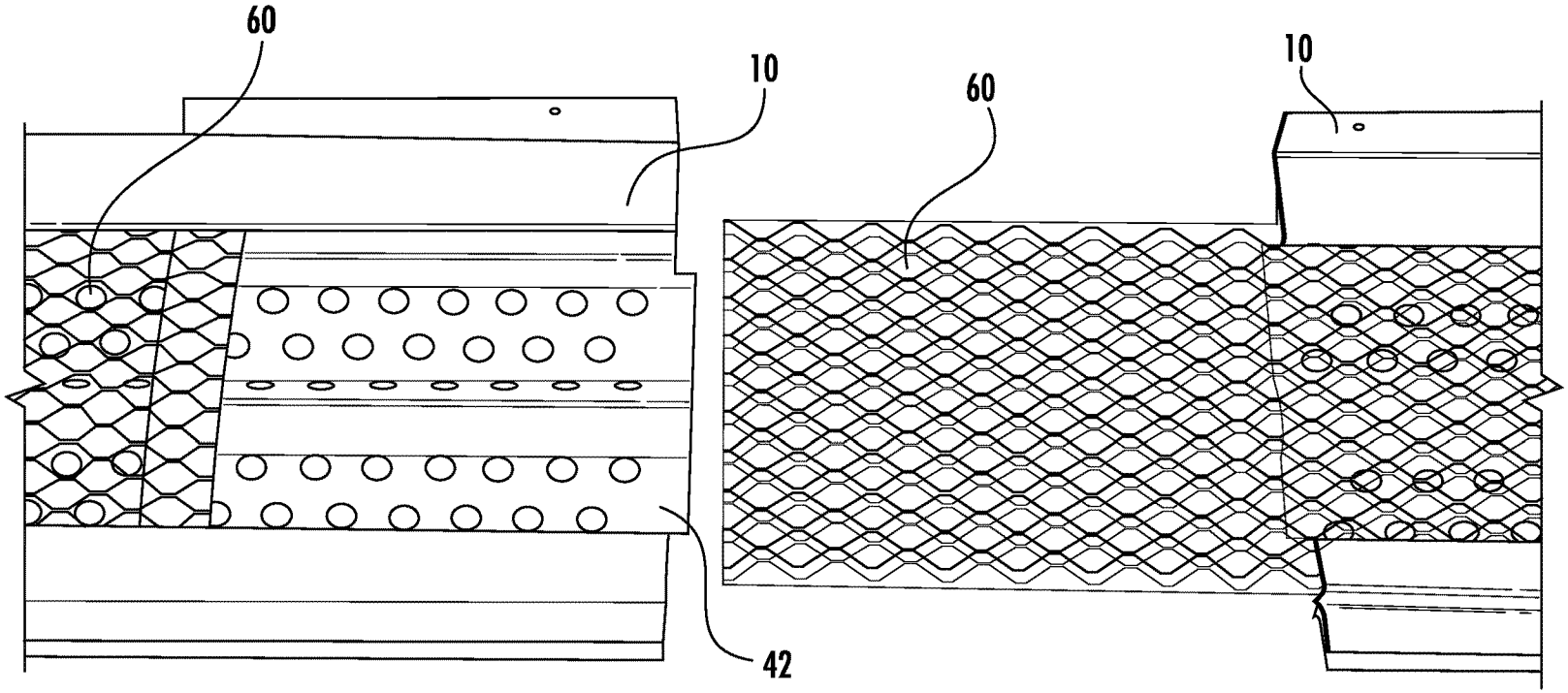
FIG. 10 illustrates the first step of joining two sections of frame and filter together.

Referring to FIG. 10, the first step of joining two sections of frame and filter together is shown.

Two frames 10 are shown, each with a filter 60. The filter 60 in the frame 10 on the left is moved away from the frame 10 end, leaving room for the filter 60 in the frame 10 on the right to slide in. The overlap tab 42 is shown, where the two frames 10 will mechanically overlap to create a strong connection.

Figure 11:
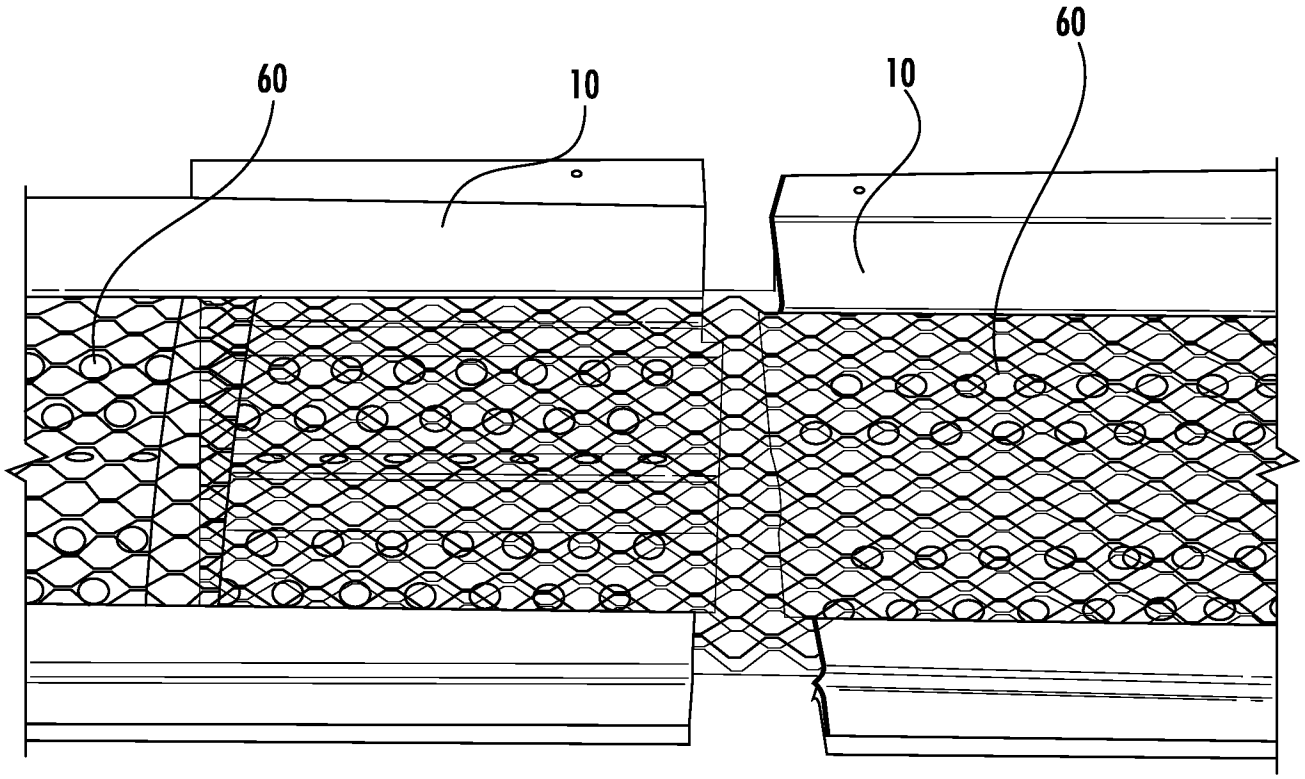
FIG. 11 illustrates the second step of joining two sections of frame and filter together.

Referring to FIG. 11, the second step of joining two sections of frame and filter together is shown.

The frames 10 are slid together, and the filter 60 on the right is placed into the lower filter capture channel 20. The filters 60 are intentionally overlapped to avoid any break in the filters. The joint between the frames 10 is offset from the filters 60 to avoid creating a weak spot.

Figure 12:
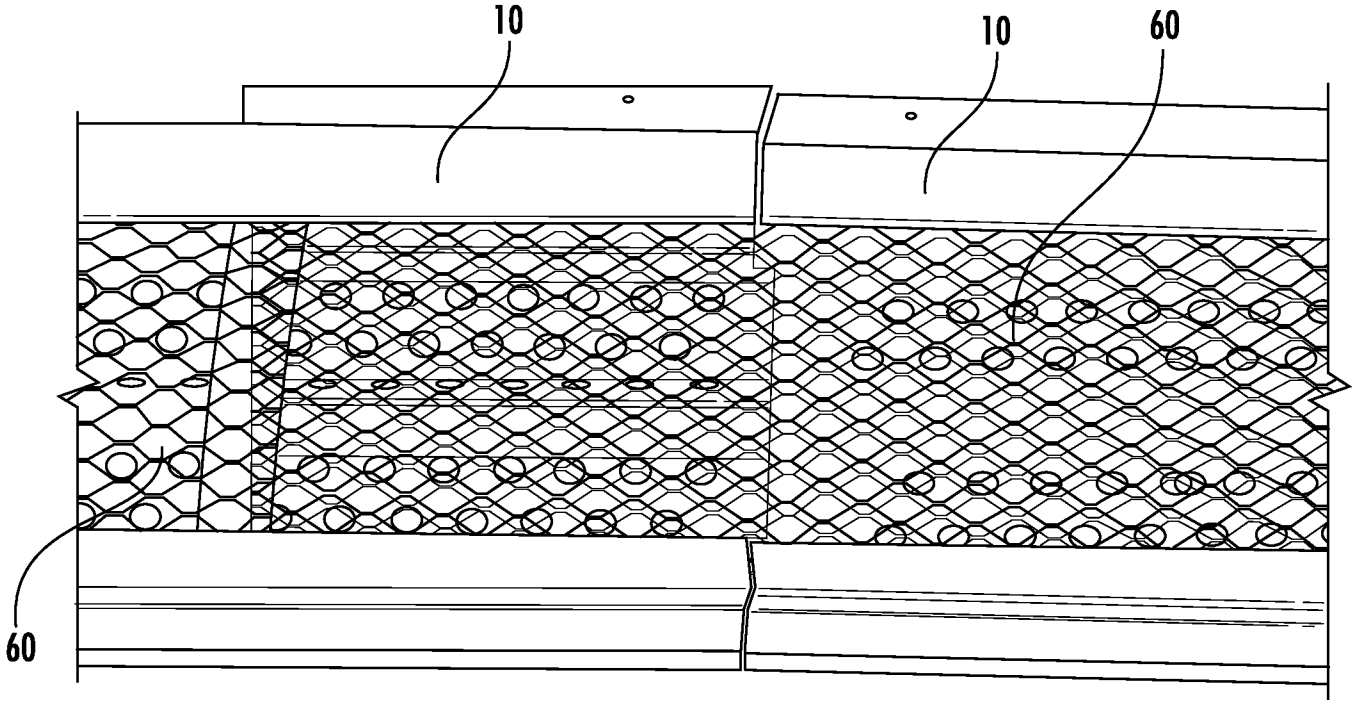
FIG. 12 illustrates the final step of joining two sections of frame and filter together.

Referring to FIG. 12, the final step of joining two sections of frame and filter together is shown. The filter 60 on the right is placed into the upper filter capture channel 19, thus locking the filter 60 into the frame 10 on the left. The filters 60 are shown overlapping. The frames 10 are butted against each other, the overlap tab 42 (hidden) acting to stiffen the connection between the frames 10.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A gutter protection device that allows for removal and installation of multiple filter types, the device comprising:

a. a frame, the frame including;
   i. an upper filter capture channel; and
   ii. a lower filter capture channel;
   iii. a collection channel that separates the upper filter capture channel and the lower filter capture channel;
   iv. a multiplicity of drain holes within the collection channel;

b. a stiffening rib formed within the collection channel to cause water to be emptied into the center of a gutter;

c. a plurality of drain penetrations within an upper face of the stiffening rib, the plurality of drain penetrations facing the upper filter capture channel;

d. a filter;
   i. the filter retained within the device by the upper filter capture channel and the lower filter capture channel of the frame.

2. The gutter protection device of claim 1, wherein the filter is a first filter and a second filter;

a. the first filter having a first end;

b. the second filter having a second end;

c. the first end overlapping the second end, thereby preventing debris from circumventing the filter.

3. The gutter protection device of claim 2, wherein the first filter has a first penetration size and the second filter has a second penetration size and the first penetration size is different than the second penetration size.

4. The gutter protection device of claim 1, wherein the stiffening rib presses against the filter, causing the filter to bend, thus seating the filter within the upper filter capture channel and the lower filter capture channel.

5. The gutter protection device of claim 1, further comprising:

a. an end cap installed at an end of the frame;

b. the end cap acting to terminate the frame and the filter.

6. A debris exclusion device for attachment to one or more gutters of a home, the device comprising:

a. a single-piece metal frame formed with a central section for drainage and edge sections for filter retention;
   i. the central section including:
      1. a primary collection channel;
      2. a secondary collection channel; and
      3. a stiffening rib joining the primary collection channel and the secondary collection channel;
      4. drain penetrations within an upper face of the stiffening rib;
   ii. the edge sections including:
      1. an upper filter capture channel;
      2. a lower filter capture channel;
      3. an upper transition segment; and
      4. an upper attachment segment;
   iii. the drain penetrations facing the upper filter capture channel;

b. a filter;
   i. the filter formed from a material with a multiplicity of penetrations;
   ii. the filter interfacing with the upper filter capture channel and the lower filter capture channel of the frame;

c. whereby the device removes debris from rainwater prior to allowing the rainwater into the one or more gutters.

7. The debris exclusion device of claim 6, wherein the primary collection channel and second collection channel have a plurality of drain holes.

8. The debris exclusion device of claim 6, wherein the filter is a first filter and a second filter;

a. the first filter having a first end;

b. the second filter having a second end;

c. the first end overlapping the second end, thereby preventing gaps between the first filter and the second filter.

9. The debris exclusion device of claim 8, wherein a penetration size of the first filter is different than a penetration size of the second filter.

10. The debris exclusion device of claim 6, wherein the stiffening rib presses against the filter, causing the filter to bend, thus securing the filter within the upper filter capture channel and the lower filter capture channel.

11. The debris exclusion device of claim 6, further comprising:

a. an end cap installed at the end of the frame;

b. the end cap sealing the frame and filter.

* * * * *